United States Patent [19]

Ikegawa et al.

[11] Patent Number: 4,786,936

[45] Date of Patent: Nov. 22, 1988

[54] ELECTROSTATIC LATENT IMAGE DEVELOPING DEVICE

[75] Inventors: Akihito Ikegawa, Sakai; Hiroshi Mizuno, Ikoma; Hiroshi Murasaki, Ibaraki; Kouichi Etou, Takatsuki, all of Japan

[73] Assignee: Minolta Camera Kabushiki Kaisha, Osaka, Japan

[21] Appl. No.: 108,118

[22] Filed: Oct. 14, 1987

[30] Foreign Application Priority Data

Oct. 17, 1986 [JP] Japan ..... 61-248115

[51] Int. Cl.[4] ..... G03G 15/08

[52] U.S. Cl. ..... 355/300; 355/14 D; 355/3 R; 118/657; 430/203

[58] Field of Search ..... 355/3 DD, 14 D, 3 R, 355/3 DR; 118/657, 658, 651; 427/203, 205, 210, 122

[56] References Cited

U.S. PATENT DOCUMENTS 4,368,971 1/1983 Watanabe et al. ..... 355/3 DD
4,395,110 7/1983 Hosono et al. ..... 355/3 DD
4,425,382 1/1984 Tajima et al. ..... 355/3 DD X
4,558,943 12/1985 Patz ..... 355/3 DD
4,575,220 3/1986 Sakamoto et al. ..... 355/3 DD
4,615,606 10/1986 Nishikawa ..... 355/3 DD
4,624,545 11/1986 Yasuda et al. ..... 355/3 DD

*Primary Examiner*—A. C. Prescott
*Attorney, Agent, or Firm*—Burns, Doane, Swecker & Mathis

[57] ABSTRACT

An electrostatic latent image developing device including a developing sleeve which is so provided as to confront a support member for supporting an electrostatic latent image, a toner reservoir for accommodating toner, which is formed, at its one portion, with an opening and a rotatable toner supply roller which is provided in the opening so as to confront the developing sleeve. The toner supply roller is formed, on its outer peripheral surface, with a plurality of first minute recesses and is further formed, in the first minute recesses, with a plurality of second minute recesses finer the first minute recesses.

9 Claims, 5 Drawing Sheets

ELECTROSTATIC LATENT IMAGE DEVELOPING DEVICE

BACKGROUND OF THE INVENTION

The present invention relates to a developing device for developing an electrostatic latent image formed, by using an electrophotographic copying process or the like, on a surface of an electrostatic latent image support member.

A developing device has been proposed in, for example, U.S. Pat. No. 4,615,606. In this known developing device, a two-component developer composed of toner and carrier is held in a state of a magnetic brush on a surface of a developing sleeve having a magnetic roller incorporated therein. Then, upon rotation of the developing sleeve, the magnetic brush rubs against a surface of an electrostatic latent image support member such that the electrostatic latent image is developed into a visible image. Furthermore, in order to replenish the developing sleeve with the toner in amount corresponding to that of the toner consumed for development, there are provided at a bottom opening of a toner hopper disposed at a rear side of the developing sleeve, a toner supply roller confronting the developing sleeve and formed, on its surface, with minute recesses and a blade held in pressing contact with the toner supply roller. Thus, upon rotation of the toner supply roller, the toner received in the minute recesses is carried to a region where the toner supply roller and the developing sleeve confront each other, while at a portion of the toner supply roller where the blade is held in pressing contact with the toner supply roller, electric charge is imparted to the toner filled in the minute recesses. However, the above described U.S. Patent merely suggests that the minute recesses have a depth of 10 microns or more and does not disclose the minute recesses in more detail.

Therefore, if each of the minute recesses referred to above is simply formed by a cavity 50 having a smooth surface as shown in FIG. 5, a coefficient of friction between the toner and the surface of the cavity 50 is small. Thus, when the toner held on the toner supply roller passes by the blade, the toner is pushed to a downstream side of the cavity 50 by the blade and thus, is aggregated and set by a pressing force of the blade, thereby resulting in reduction of a volume of the cavity 50. Hence, the known developing device has such drawbacks that concentration of a copied image drops due to lack of amount of the toner supplied to the developing sleeve and quantity of electric charge imparted to the toner and fog occurs in the background of the copied image.

SUMMARY OF THE INVENTION

Accordingly, an essential object of the present invention is to provide a developing device in which finer minute indentations are formed at least in minute recesses on a surface of a toner supply roller, with substantial elimination of the disadvantages inherent in conventional developing devices of this kind.

Namely in the developing device of the present invention, since the finer minute indentations 51 are formed in the minute recesses 50 as shown in FIGS. 2 to 4, a force for retaining toner in each of the minute recesses 50, namely, a frictional force between the toner and a surface (minute indentations 51) of each of the minute recesses 50 is increased by the minute indentations 51.

As a result, even if the toner is subjected to a pressing force of a blade, the toner is uniformly retained in the minute recesses 50 without being carried to a downstream side of each of the minute recesses 50. Furthermore, the toner filled in the minute recesses 50 are properly electrically charged through its uniform contact with the blade.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
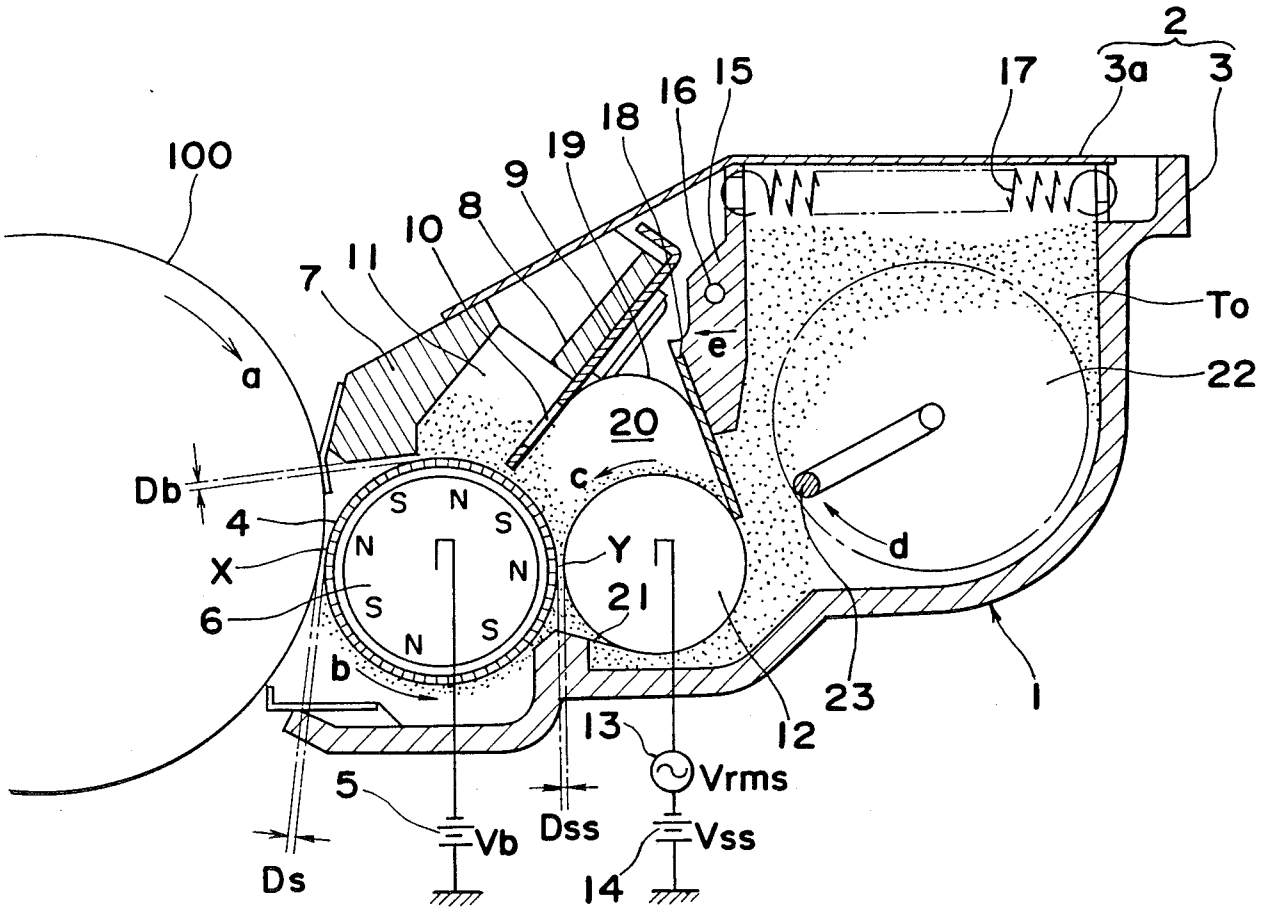
FIG. 1 is a sectional view of an electrostatic latent image developing device according to one preferred embodiment of the present invention.

Referring now to the drawings, there is shown in FIG. 1, a developing portion of a copying apparatus equipped with a developing device 1 according to one preferred embodiment of the present invention. The developing device 1 is disposed at a side of a photosensitive or photoreceptor drum 100. An electrostatic latent image of an image to be copied is formed on a surface of the photosensitive drum 100 through corona charging and exposure of the surface of the photosensitive drum 100. The developing device 1 supplies toner to the electrostatic latent image so as to develop the electrostatic latent image into a visible toner image. In FIG. 1, the developing device 1 includes a developing sleeve 4 and a toner supply roller 12 which are arranged rightwards in this order from the photosensitive drum 100 in a developing tank 2 constituted substantially by a casing 3 and a cover 3*a*. In the developing tank 2, a toner reservoir 15 is defined at a right side of the toner supply roller 12.

The developing sleeve 4 is made of an electrically conductive non-magnetic material such as aluminium and has a cylindrical shape. The developing sleeve 4 is formed, on its surface, with minute recesses by blasting and confronts, through a developing gap Ds, the photosensitive drum 100 driven for its rotation in the direction of the arrow a so as to be driven for its rotation in the counterclockwise direction of the arrow b. Meanwhile, a DC developing bias power source 5 having a developing bias voltage Vb is connected between the developing sleeve 4 and ground. The negative terminal of the developing bias power source 5 is connected to the developing sleeve 4.

A magnetic roller 6 is incorporated in the developing sleeve 4 and is constituted by a plurality of magnets having magnetic poles extending in an axial direction of the developing sleeve 4 such that the N(north)-poles and the S(south)-poles are arranged alternately along the outer peripheral surface of the developing sleeve 4. The magnetic roller 5 is secured at the position shown in FIG. 1.

A main stirring plate 7 for stirring developer is attached, above the developing sleeve 4 and in the vicinity of the photosensitive drum 100, to the cover 3*a* so as to confront the developing sleeve 4 through a bristle height regulating gap Db. Meanwhile, an auxiliary stirring plate 9 for stirring the developer is attached, at a position disposed obliquely rightwardly and upwardly of the developing sleeve 4, to a support portion 8 of the cover 3*a* so as to confront the developing sleeve 4. A hollow 11 is defined above the developing sleeve 4 by the main stirring plate 7 and the auxiliary stirring plate 9. The auxiliary stirring plate 9 is formed with a slit 10 extending in an axial direction of the developing sleeve 4.

Figure 2:
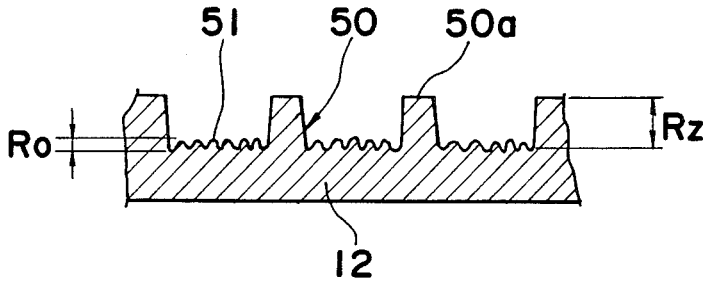
FIGS. 2 to 4 are enlarged fragmentary sectional views of examples of a surface of a toner supply roller employed in the developing device of FIG. 1.

The toner supply roller 12 is made of an electrically conductive non-magnetic material such as aluminium and is disposed at one side of the developing sleeve 4 remote from the photosensitive drum 100. The toner supply roller 12 axially extends in parallel with the developing sleeve 4 so as to be spaced a supply gap Dss from the developing sleeve 4 and is driven for its rotation in the direction of the arrow c. As shown in FIG. 2, minute recesses 50 are formed on the outer peripheral surface of the toner supply roller 12 by a processing to be described in detail later. Furthermore, minute indentations 51 of a surface roughness of about 5–10 $\mu$m are formed on the surface of each of the minute recesses 50. It is to be noted here that the surface roughness is expressed by an average of measured values obtained at ten locations of measurement, hereinbelow. Meanwhile, convex portions 50*a* of the toner supply roller 12 is finished to mirror surface. The toner supply roller 12 is connected to ground through an AC power source 13 and a DC power source 14. Thus, a recovery bias voltage of pulsating current is applied to the toner supply roller 12.

At a side of the toner supply roller 12 remote from the photosensitive drum 100 and above the toner supply roller 12, a partition wall 15 is pivotally supported by a support shaft 16 so as to be pivoted about the support shaft 16. A tension spring 17, which is attached, at its one end, to an upper rear end portion of the developing tank 2, is attached, at the other end, to an upper end portion of the partition wall 15 so as to urge the partition wall 15 in the direction of the arrow e at all times. Thus, a distal end portion of a toner regulating blade 18 attached to a lower portion of the partition wall 15 is brought into light pressing contact with the surface of the toner supply roller 12 against the rotational direction of the arrow c of the toner supply roller 12 by the tension spring 17. Meanwhile, the toner regulating blade 18 and the auxiliary stirring plate 9 are coupled with each other by a sheet 19 so as to define a hollow 20 above the toner supply roller 12.

Furthermore, below the toner supply roller 12, a film 21 for preventing return of the toner is attached to the casing 3 so as to be brought into pressing contact with the toner supply roller 12 along the rotational direction of the arrow c of the toner supply roller 12.

The toner reservoir 22 is bounded, in a rear portion of the developing tank 2, by the partition wall 15, the toner regulating blade 18, the toner supply roller 12 and the film 21. In the toner reservoir 22, a stirring rod 23 for preventing blocking, etc. of the toner To accommodated in the toner reservoir 22 is rotatably provided so as to be rotated in the direction of the arrow d.

Hereinbelow, operation of the developing device 1 of the above described arrangement is described. Initially, starter, which is a mixture of magnetic carrier electrically charged to negative polarity and insulating toner electrically charged to positive polarity, is loaded into the hollow 11 defined above the developing sleeve 4 and the toner supply roller 12, while the insulating toner is loaded into the toner reservoir 22. At this time, it can also be so arranged that only the magnetic carrier is loaded into the hollow 11 in place of the starter referred to above. Thus, an electrostatic latent image can be developed into a visible image by the developing device 1.

Figure 6:
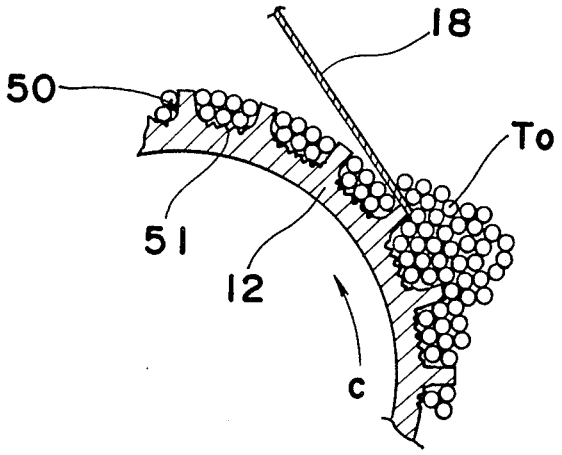
FIG. 6 is a sectional view indicative of regulation of toner in the developing device of FIG. 1.

When a print switch (not shown) is turned on in this state, the developing sleeve 4, the toner supply roller 12 and the stirring rod 23 are rotated in the directions of the arrows b, c and d, respectively. By the above described operation of the developing device 1, the toner To in a bottom portion of the toner reservoir 22 flows towards the toner supply roller 12 by stirring action of the stirring rod 23. Then, the toner is received and filled into the minute recesses 50 formed on the surface of the toner supply roller 12. Subsequently, the toner To, which has been supplied to the toner supply roller 12, is transported in the direction of the arrow c as shown in FIG. 6. Thus, surplus toner To is scraped off from the toner supply roller 12 by the toner regulating blade 18 and the toner To is triboelectrically charged through its contact with the toner regulating blade 18 so as to proceed to a toner supply region y where the toner supply roller 12 and the developing sleeve 4 confront each other.

Meanwhile, the toner filled into the minute recesses 50 is positively retained in the minute recesses 50 through its contact with the finer minute indentations 51 formed on the surface of each of the minute recesses 50. Therefore, even if the toner To is subjected to a scraping force of the toner regulating blade 18 while passing through a region where the toner supply roller 12 and the toner regulating blade 18 confront each other, such a state is kept that the toner To is uniformly filled in the minute recesses 50 without being pushed to a downstream side of each of the minute recesses 50, i.e. in the direction opposite to the arrow c as shown in FIG. 6. Furthermore, the toner To filled in the minute recesses 50 is electrically charged uniformly through its uniform contact with the toner regulating blade 18.

In the toner supply region Y, the toner To is supplied to the developer retained on the developing sleeve 4, while surplus toner on the developing sleeve 4 is collected by the toner supply roller 12. Supply and collection of the toner To will be described in detail later. The toner To supplied to the developing sleeve 4 is transported, together with the carrier retained on the outer peripheral surface of the developing sleeve 4, in the direction of the arrow b upon rotation of the developing sleeve 4. Most of the developer is blocked by the auxiliary stirring plate 9. Then, the blocked developer is pushed by the developer transported subsequently so as to rise upwardly along the auxiliary stirring plate 9 and then, is drawn into the hollow 11 through the slit 10. The remaining developer passes through a gap between the auxiliary stirring plate 9 and the developing sleeve 4 so as to proceed to the hollow 11.

The developer carried into the hollow 11 is blocked by the main stirring plate 7 and rises upwardly along the main stirring plate 7 while rotating in the clockwise direction. Subsequently, the developer falls down in the hollow 11 so as to be mixed with the developer passing through the slit 10. A portion of the developer thus sufficiently stirred for mixing thereof passes through the bristle height regulating gap Db between the developing sleeve 4 and the main stirring plate 7 so as to form a magnetic brush. This magnetic brush rubs against the surface of the photosensitive drum 100 in a developing region X so as to develop an electrostatic latent image on the surface of the photosensitive drum 100 into a visible image.

After passing through the developing region X, the developer remaining on the outer peripheral surface of the developing sleeve 4 is successively transported in the direction of the arrow b upon rotation of the developing sleeve 4 and then, reaches the toner supply region Y where the developing sleeve 4 and the toner supply roller 12 confront each other. At this time, new toner is supplied to the developing sleeve 4 by the toner supply roller 12 and surplus toner on the developing sleeve 4 is collected by the toner supply roller 12 as described above. Then, when the toner To supplied to the developing sleeve 4 has reached the hollows 20 and 11 again, the developer stirred in the hollows 20 and 11 sufficiently for mixing thereof is uniformly replenished to the surface of the developing sleeve 4 so as to eliminate a consumption pattern of the toner consumed in the previous development.

On the other hand, the toner collected by the toner supply roller 12 is received in the minute recesses 50 and passes between the toner supply roller 12 and the film 21. When the toner has reached the toner reservoir 22, the toner is replenished to the minute recesses 50 of the toner supply roller 12 again.

Hereinbelow, supply and collection of the toner in the toner supply region Y are described. In the toner supply region Y, the developer on the developing sleeve 4 is linked like a chain along a magnetic field produced in the radial direction from the magnetic poles (N-poles) of the magnetic roller 6 so as to form the magnetic brush. Meanwhile, the toner is filled in the minute recesses 50 on the surface of the toner supply roller 12. Especially, electrically charged toner in the minute recesses 50 has a large electrostatic attraction force relative to the toner supply roller 12 by its electrostatic force. However, since a bias voltage of (Vss+Vrms) of the DC power source 14 and the AC power source 13 is applied to the toner supply roller 12, the electrically charged toner referred to above is vibrated on the surface of the toner supply roller 12 towards the developing sleeve 4 upon periodical change of the AC voltage Vrms. Therefore, the toner on the toner supply roller 12 is frequently brought into contact with the magnetic brush on the developing sleeve 4. Namely, not only the toner disposed at an upper portion of each of the minute recesses 50 but the toner disposed at a bottom portion of each of the minute recesses 50 is brought into contact with the magnetic brush so as to be efficiently scraped off from the toner supply roller 12 by the magnetic brush.

Meanwhile, on the developing sleeve 4, the surplus toner, which is electrically charged to positive polarity through its contact with the carrier, is electrically attracted by the toner supply roller 12 on the basis of a difference between the bias voltage Vb for the developing sleeve 4 and the bias voltage of (Vss+Vrms) for the toner supply roller 12. Since this attraction force also changes periodically under the influence of the AC power source 13, an electrostatic attraction force between the surplus toner and the carrier is reduced, so that the surplus toner is readily dissociated from the carrier and thus, the surplus toner is efficiently collected by the toner supply roller 12.

As described above, since amount of the toner To supplied and collected between the developing sleeve 4 and the toner supply roller 12 is increased remarkably and variations of amount of the toner are decreased, amount of the toner transported to the developing region X is stabilized and thus, a copied image free from non-uniform concentration can be obtained. The toner To collected by the toner supply roller 12 enters the minute recesses 50. Then, when the minute recesses 50 with the collected toner To have reached the toner reservoir 22 through the film 21, new toner To is again filled into the minute recesses 50 and the same operation as described above is repeated thereafter.

Figure 5:
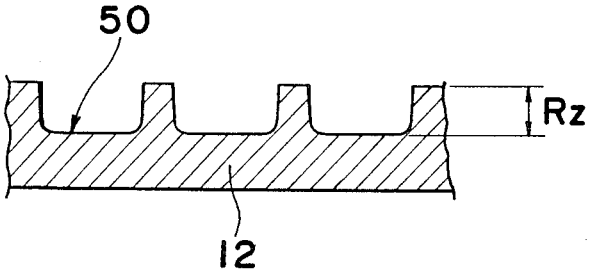
Fig. 5 PRIOR ART
FIG. 5 is an enlarged fragmentary sectional view of minute recesses of a toner supply roller employed in a prior art developing device.

Hereinbelow, experimental results are described of the developing device 1 of the above described arrangement in which the finer minute indentations 51 are formed in the minute recesses 50 on the surface of the toner supply roller 12 and the prior art developing device in which the toner supply roller 12 is formed with the minute recesses 50 each having a smooth surface as shown in FIG. 5. In the experiments, relation between surface roughness of the toner supply roller 12 and amount of the toner adhering to the surface of the toner supply roller 12 and relation between amount of the toner adhering to the surface of the toner supply roller 12 and quantity of electric charge imparted to the toner were examined through measurement on the toner supply roller 12 under the following conditions. A location of measurement is set at a position which is disposed forwardly of a point of replenishment of the toner to the developing sleeve 4 after the toner has been regulated by the toner regulating blade 18.

[Experimental conditions]

a. Developing sleeve 4
   * Diameter=24.5 mm
   * Number of revolutions=200 rpm
   * Developing bias voltage Vb=−200 V (DC)

b. Toner supply roller 12
   * Diameter=20 mm
   * Number of revolutions=200 rpm
   * Recovery bias voltage=−400 V (DC), 700 V (AC)
   * AC frequency=300 Hz
   * Depth Rz of minute recesses 50=10 μm, 25 μm, 40 μm

* Surface area of minute recesses 50=80% c. Gap
* Developing gap Ds=0.6 mm
* Bristle height regulating gap Db=0.45 mm
* Supply gap=0.8 mm d. Toner regulating blade 18
* Thickness=150 μm
* Pressing contact force=0.7 g/mm e. Developer
* Styrene series toner having an average particle diameter of 13.5 μm
* Carrier having an average particle diameter of 60 μm and containing magnetic powder in resin Meanwhile, it is to be noted that the minute recesses 50 of the present invention are formed as shown in FIG. 2, while the minute recesses 50 of the prior art developing device are formed as shown in FIG. 5. Furthermore, a depth Ro of the minute indentations 51 is set at 5 to 10 μm.

Figure 8:
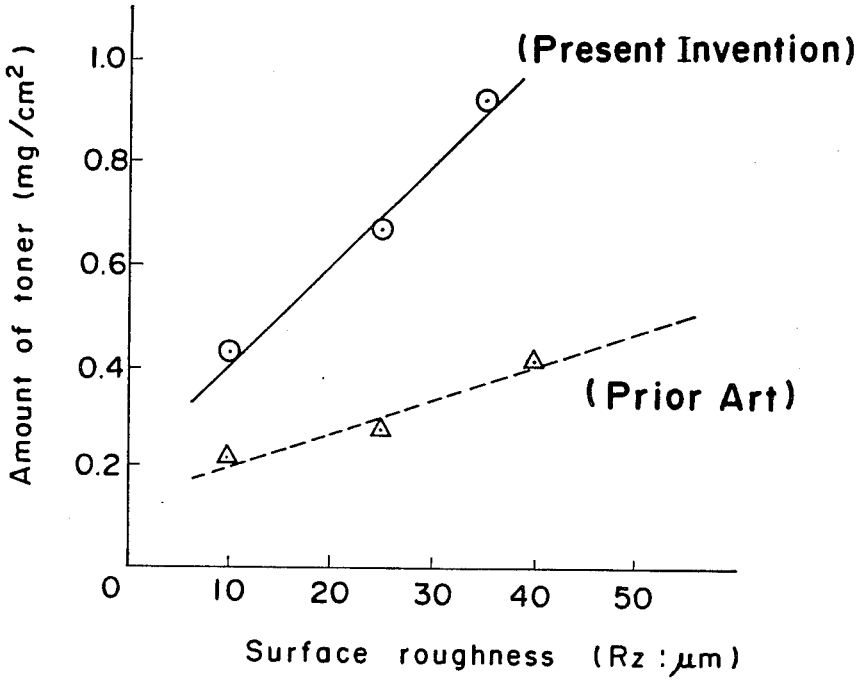
FIG. 8 is a graph indicative of relation between surface roughness of the toner supply roller and amount of the toner adhering to the toner supply roller in the developing device of FIG. 1 and the prior art developing device of FIG. 5.
Figure 9:
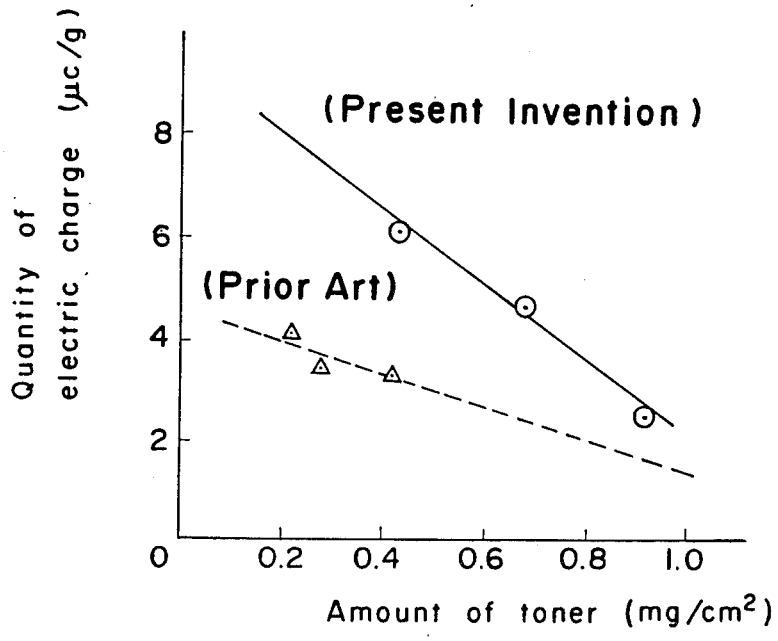
FIG. 9 is a graph indicative of relation between amount of the toner adhering to the toner supply roller and quantity of electric charge imparted to the toner in the developing device of FIG. 1 and the prior art developing device of FIG. 5.

The experimental results are shown in FIGS. 8 and 9. As is seen from FIG. 8, when the surface of the minute recesses 50 on the surface of the toner supply roller 12 is made rough by forming the finer minute indentations 51 in the minute recesses 50 in the present invention, amount of the toner adhering to the toner supply roller 12 has increased to about twice that of the prior art developing device. However, when surface roughness of the toner supply roller 12, i.e. a depth Rz of the minute recesses 50 exceeds 70 μm, aggregation of the toner starts, thereby resulting in occurrence of fog in a copied image. Thus, it can be concluded that the minute recesses 50 desirably have a depth of not more than 70 μm.

Meanwhile, as is apparent from FIG. 9, quantity of electric charge imparted to the toner in the present invention also has increased to approximately twice that of the prior art developing device. Thus, in the present invention, since amount of the toner supplied to the developing sleeve 4 and quantity of electric charge imparted to the toner are increased as compared with the prior art developing device, fog in the background of a copied image has been eliminated substantially.

Figure 10:
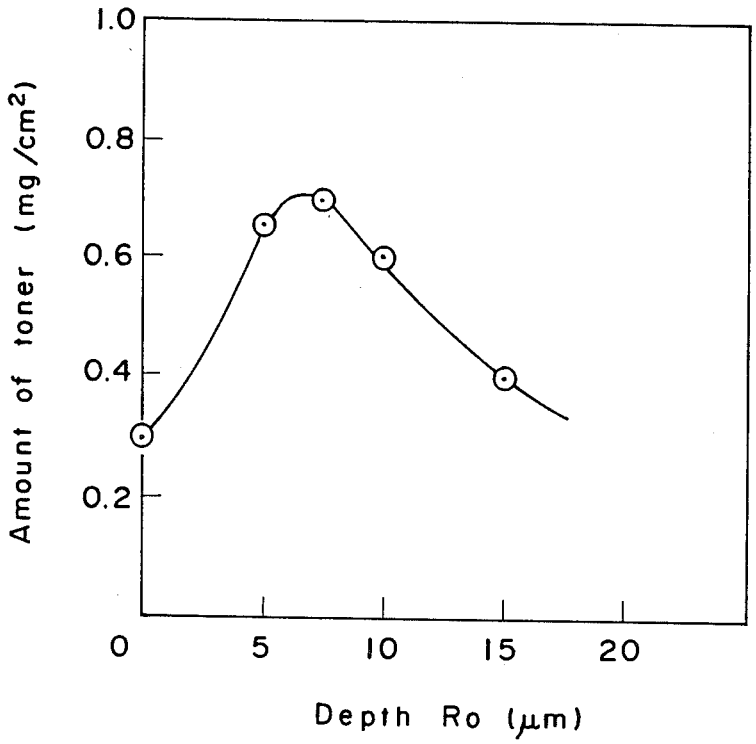
FIG. 10 is a graph indicative of relation between depth of minute indentations of the toner supply roller and amount of the toner adhering to the toner supply roller in the developing device of FIG. 1.

Then, another experiment for obtaining relation between the depth Ro of the minute indentations 51 and amount of the toner adhering to the toner supply roller 12 was performed by changing the depth Ro of the minute indentations 51 on the same conditions as described above except that the depth Rz of the minute recesses 50 is set at 25 μm. The result of this experiment is shown in FIG. 10. As will be understood from FIG. 10, the amount of toner adhering to the toner supply roller 12 reaches its maximum when the depth Ro of the minute indentations 51 ranges between 5 and 10 μm.

Figure 7:
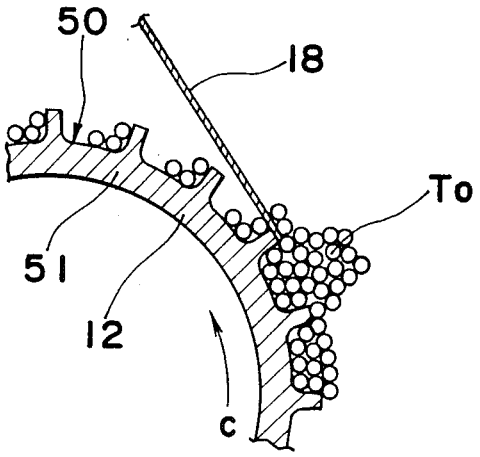
Fig. 7 PRIOR ART
FIG. 7 is a sectional view indicative of regulation of toner in the prior art developing device of FIG. 5.

FIGS. 6 and 7 show, on an enlarged scale, results of visual inspection of the toner To adhering to the surface of the toner supply roller 12 in the developing device 1 of the present invention and the prior art developing device, respectively. As is seen from FIG. 7, in the toner supply roller 12 of the prior art developing device, in which the surface of the minute recesses 50 is smooth, the toner To is packed to the downstream side of each of the minute recesses 50, so that the volume of the minute recesses 50 is substantially reduced and thus, amount of the toner filled in the minute recesses 50 is reduced. Hence, in order to obtain a necessary amount of the toner supplied to the developing sleeve 4 in the prior art developing device, it becomes necessary to further increase the depth Rz of the minute recesses 50. However, if the depth Rz of the minute recesses 50 is increased, the toner pushed to the downstream side of each of the minute recesses 50 is aggregated. As a result, lumps of the aggregated toner are replenished to the developing sleeve 4, thereby resulting in occurrence of fog in a copied image. Furthermore, if the depth Rz of the minute recesses 50 is increased, probability of triboelectric charging of the toner To through contact between the toner regulating blade 18 and the toner To and between the toner supply roller 12 and the toner To at the time of regulation of the toner To by the toner regulating blade 18 decreases, so that quantity of electric charge imparted to the whole toner is reduced and thus, fog is likely to occur in a copied image.

On the other hand, as shown in FIG. 6, in the toner supply roller 12 of the developing device 1 of the present invention, in which the surface of the minute recesses 50 are made rough by forming thereon the minute indentations 51, since a coefficient of friction between the minute indentations 51 and the toner To is large, such a state is kept at the time of regulation of the toner To by the toner regulating blade 18 that the toner To is uniformly filled in the minute recesses 50 without deviating to the downstream side of each of the minute recesses 50. Accordingly, in the developing device 1 of the present invention, the depth Rz of the minute recesses 50, which is required for securing a predetermined amount of the toner supplied to the developing sleeve 4 can be made small. To this end, the toner To having a thickness of one or two layers is sufficient. Furthermore, the toner To is replenished, as a uniform layer, to the developing sleeve 4 without aggregation of the toner To. Meanwhile, since the thickness of the toner To in the minute recesses 50 is small, probability of triboelectric charging of the toner To through contact between the toner regulating blade 18 and the toner To and between the toner supply roller 12 and the toner To at the time of regulation of the toner To by the toner regulating blade 18 increases, so that amount of electric charge imparted to the whole toner To is increased, thereby eliminating fog in a copied image.

Meanwhile, the minute recesses 50 can be formed by employing known processings such as blasting, knurling, photoetching utilized in manufacture of semiconductors, etc. On the other hand, the minute indentations 51 can be formed by blasting using blasting medium having a size smaller than that for the minute recesses 50. Furthermore, in order to finish portions other than the minute recesses 50, i.e. the convex portions 50*a* to mirror surface as shown in FIG. 2, the minute indentations 51 are formed by blasting the toner supply roller 12 wholly and then, the surface of the convex portions 50*a* is ground by a proper means. The depth Rz of the minute recesses 50 and the depth Ro of the minute indentations 51 are so set as to be larger and smaller than a particle diameter of the toner To, respectively in order to achieve the above described effects.

Figure 3:
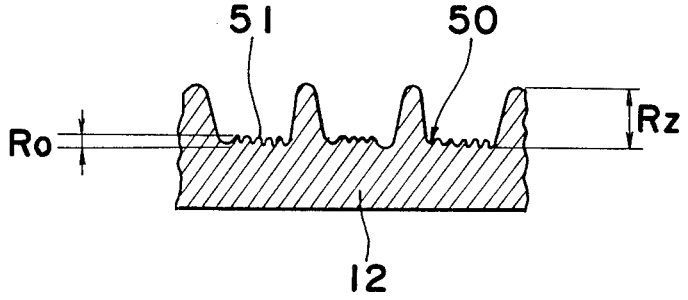
Figure 4:
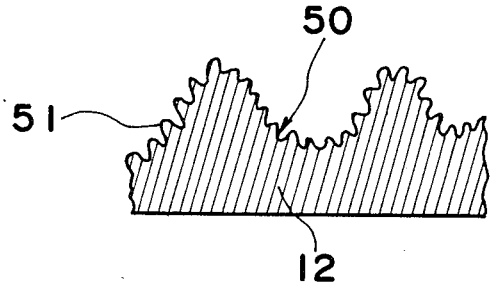

In the above described embodiment, although the minute recesses 50 are formed as shown in FIG. 2, it can also be so arranged that the minute recesses 50 are formed as shown in FIG. 3 or 4.

Meanwhile, in order to adjust quantity of electric charge imparted to the toner, the surface of the toner supply roller 12 may be coated with resin, etc. Furthermore, in order to increase surface hardness of the toner supply roller 12, the surface of the toner supply roller 12 may be coated with anodized aluminium.

As is clear from the foregoing description, in the electrostatic latent image developing device of the present invention including the toner supply roller formed, on its surface, with the minute recesses and the toner regulating blade in pressing contact with the toner supply roller such that the toner filled in the minute recesses is supplied to the surface of the developing sleeve upon rotation of the toner supply roller, the finer minute indentations are formed at least in the minute recesses on the surface of the toner supply roller.

Accordingly, in accordance with the present invention, a force for retaining the toner in the minute recesses, namely a frictional force between the toner and the surface (minute indentations) of the minute recesses is increased. Thus, even if the toner is subjected to pressing contact force of the toner regulating blade, such a phenomenon does not take place that the toner deviates to the downstream end of each of the minute recesses, thereby resulting in aggregation or setting of the toner.

Therefore, since an amount of the toner supplied from the minute recesses to the developing sleeve is substantially identical with a volume of the minute recesses, efficiency for supplying the toner from the minute recesses to the developing sleeve is raised and it becomes possible to stably obtain a high-quality copied image free from non-uniform concentration.

Furthermore, in accordance with the present invention, since the toner filled uniformly in the minute recesses is properly electrically charged through its contact with the toner regulating blade, it becomes possible to obtain a sharp image free from fog in the background, etc. owing to defective electric charging and such an undesirable phenomenon can be obviated that inside of the copying apparatus is contaminated through scattering of the toner which has not been electrically charged.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing device comprising:

a developing sleeve which is so provided as to confront a support member for supporting an electrostatic latent image;

a toner reservoir for accommodating toner, which is formed, at its one portion, with an opening; and a rotatable toner supply roller which is provided in said opening so as to confront said developing sleeve;

said toner supply roller being formed, on its outer peripheral surface, with a plurality of first minute recesses;

said toner supply roller being formed, in said first minute recesses, with a plurality of second minute recesses finer than said first minute recesses.

2. A developing device as claimed in claim 1, further comprising:

a toner regulating means for regulating an amount of the toner transported from said toner reservoir to said developing sleeve, which is provided in contact with the outer peripheral surface of said toner supply roller.

3. A developing device as claimed in claim 2, wherein said toner regulating means is a blade.

4. A developing device comprising:

a developing sleeve which is so provided as to confront a support member for supporting an electrostatic latent image;

a magnetic roller which is provided in said developing sleeve;

a toner reservoir for accommodating toner, which is formed, at its one portion, with an opening; and a rotatable toner supply roller which is provided in said opening so as to be brought into contact with a magnetic brush formed on said developing sleeve;

said toner supply roller being formed, on its outer peripheral surface, with a plurality of first minute recesses;

said toner supply roller being formed, in said minute recesses, with a plurality of second minute recesses finer than said first minute recesses.

5. A developing device as claimed in claim 4, further comprising:

a toner regulating means for regulating an amount of the toner transported from said toner reservoir to said developing sleeve, which is provided in contact with the outer peripheral surface of said toner supply roller.

6. A developing device as claimed in claim 5, wherein said toner regulating means is a blade.

7. A developing device as claimed in claim 4, wherein at least one of said developing sleeve and said magnetic roller is driven for its rotation.

8. A developing device as claimed in claim 4, wherein said magnetic roller is fixedly provided and said developing sleeve is driven for its rotation.

9. A developing device as claimed in claim 4, wherein each of said first minute recesses has a size larger than a particle diameter of the toner and each of said second minute recesses has a size smaller than the particle diameter of the toner.

* * * * *